US010391344B2

(12) United States Patent
McHugh, IV et al.

(10) Patent No.: US 10,391,344 B2
(45) Date of Patent: Aug. 27, 2019

(54) PURGE AND VENT VALVE ASSEMBLY

(71) Applicant: AGF Manufacturing Inc., Malvern, PA (US)

(72) Inventors: George J. McHugh, IV, Malvern, PA (US); James P. McHugh, Newtown Square, PA (US); Bentley F. Gleeson, Plymouth Meeting, PA (US)

(73) Assignee: AGF MANUFACTURING INC., Malvern, PA (US)

( * ) Notice: Subject to any disclaimer, the term of this patent is extended or adjusted under 35 U.S.C. 154(b) by 0 days.

(21) Appl. No.: 15/615,292

(22) Filed: Jun. 6, 2017

(65) Prior Publication Data

US 2018/0221696 A1 Aug. 9, 2018

Related U.S. Application Data

(63) Continuation-in-part of application No. 15/427,467, filed on Feb. 8, 2017.

(51) Int. Cl.
*A62C 35/68* (2006.01)
*A62C 35/60* (2006.01)

(52) U.S. Cl.
CPC ..... *A62C 35/68* (2013.01); *A62C 35/60* (2013.01)

(58) Field of Classification Search
CPC ..... A62C 35/60; A62C 35/68; A62C 35/605
USPC ..... 137/589; 169/16–18; 138/39; 285/133.4
See application file for complete search history.

(56) References Cited

U.S. PATENT DOCUMENTS

| | | | | |
|---|---|---|---|---|
| 1,459,594 | A | 6/1923 | McWhorter et al. | |
| 2,187,906 | A | 1/1940 | Lowe | |
| 3,002,522 | A | 10/1961 | Klinefelter | |
| 3,905,424 | A | 9/1975 | Elwood et al. | |
| 3,969,092 | A | 7/1976 | Huffman et al. | |
| 4,197,097 | A | 4/1980 | Magorien et al. | |
| 4,991,655 | A | 2/1991 | McHugh | |
| 5,579,803 | A * | 12/1996 | Welker | F16K 24/046 137/202 |
| 5,588,462 | A | 12/1996 | McHugh | |
| 5,611,218 | A | 3/1997 | Naumovitz | |
| 5,660,618 | A | 8/1997 | Park | |

(Continued)

FOREIGN PATENT DOCUMENTS

| | | | |
|---|---|---|---|
| JP | 2006-247237 | A | 9/2006 |
| JP | 2008-73227 | A | 4/2008 |
| WO | 2015/175684 | A1 | 11/2015 |

OTHER PUBLICATIONS

Kinsley, Jr., G.R., "Properly Purge and Insert Storage Vessels", CEP, Safety, pp. 57-61, Feb. 2001.

(Continued)

*Primary Examiner* — Marina A Tietjen
*Assistant Examiner* — Paul J Gray
(74) *Attorney, Agent, or Firm* — Buchanan Ingersoll & Rooney PC

(57) ABSTRACT

Described herein are a valve assembly, an air vent assembly, an air release assembly, and a moisture detection assembly all suitable for use in connection with a wet pipe network. The valve assembly, the air vent assembly, the air release assembly, and moisture detection assembly are each configured to vent gas (e.g., air) remaining in a piping system when the system is filled with a fluid, and in particular, to vent air in a fire sprinkling system.

15 Claims, 9 Drawing Sheets

(56) References Cited

U.S. PATENT DOCUMENTS

| | | | | |
|---|---|---|---|---|
| 5,803,180 | A | 9/1998 | Talley | |
| 6,024,116 | A | 2/2000 | Almberg et al. | |
| 6,076,278 | A | 6/2000 | Bradley | |
| 6,221,263 | B1 | 4/2001 | Pope et al. | |
| 6,415,870 | B1 | 7/2002 | Matsuoka | |
| 6,578,602 | B1 * | 6/2003 | Kirschner | A62C 35/68 137/312 |
| 6,581,694 | B2 | 6/2003 | Golner et al. | |
| 6,601,604 | B1 | 8/2003 | Cooper | |
| 6,601,653 | B2 | 8/2003 | Grabow et al. | |
| 6,841,125 | B1 | 1/2005 | Chartier et al. | |
| 6,860,331 | B2 * | 3/2005 | Hagen | A62C 35/68 169/16 |
| 6,926,023 | B2 | 8/2005 | Cabral et al. | |
| 6,960,321 | B1 | 11/2005 | Ludwig | |
| 7,066,186 | B2 | 6/2006 | Bahr | |
| 7,104,336 | B2 | 9/2006 | Ozment | |
| 7,124,834 | B2 | 10/2006 | Sundholm et al. | |
| 7,389,824 | B2 | 6/2008 | Jackson | |
| 7,594,545 | B2 | 9/2009 | Love | |
| 7,673,694 | B2 | 3/2010 | Wagner et al. | |
| 7,717,776 | B2 | 5/2010 | Wagner et al. | |
| 8,113,313 | B2 * | 2/2012 | Lynch | F16L 41/021 137/13 |
| 8,122,968 | B2 | 2/2012 | Johnson | |
| 8,636,023 | B2 | 1/2014 | Burkhart et al. | |
| 2006/0043204 | A1 | 3/2006 | Ito et al. | |
| 2007/0000258 | A1 | 1/2007 | Bonaquist et al. | |
| 2009/0208659 | A1 | 8/2009 | Sundholm | |
| 2010/0065287 | A1 | 3/2010 | Burkhart et al. | |
| 2011/0094758 | A1 | 4/2011 | Burkhart et al. | |
| 2011/0108123 | A1 * | 5/2011 | Burkhart | A62C 35/60 137/2 |
| 2011/0146811 | A1 | 6/2011 | Miller | |
| 2011/0226495 | A1 | 9/2011 | Burkhart et al. | |
| 2011/0233929 | A1 | 9/2011 | Olsen | |
| 2013/0092255 | A1 * | 4/2013 | Lang, III | F16K 24/042 137/409 |
| 2013/0220442 | A1 | 8/2013 | Balutto | |
| 2014/0251449 | A1 | 9/2014 | Chen | |
| 2016/0129291 | A1 | 5/2016 | Bodemann | |
| 2017/0072237 | A1 * | 3/2017 | Kochelek | A62C 35/62 |

OTHER PUBLICATIONS

Potter, "Potter Air Vent", Rev. D, pp. 1-2.

Engineered Corrosion Solutions, ECS Ejector Automatic Air Vent (PAV-W), Rev. 3, 2 pages, Apr. 2016.

South-Tek Systems, "DeOx—Wet Air Vent Solutions", p. 1.

Potter, "PAAR-B Potter Automatic Air Release", Rev. C, pp. 1-3.

Potter Electric, "Sprinkler Monitoring Training Manual", 46 pages, Retrieved online on Mar. 27, 2009 at http:pottersignal.com/sprinkler_datasheets.aspx.

General Air Products, "Dry Air Pac FM Approved Compressor Dryer Package for Critical Applications from Generators", 2009, 4 pages, Retrieved online on Mar. 27, 2009 at http://www.generalairproducts.com/fireprotection/content/view/16/88/.

General Air Products, Desiccant Dryers, 2 pages, Retrieved online on Mar. 27, 2009 at http://www.generalairproducts.com/pages2/desiccant-dryers.html.

Engineered Corrosion Solutions, Ejector Automatic Air Vent product information, 3 pages, Mar. 30, 2009.

Engineered Corrosion Solutions, Ejector Automatic Air Vent product information, 3 pages, Jul. 15, 2008.

O'Keefe Controls Co., Metal Orifice Assemblies product information, 6 pages, 2006.

Office Action dated Apr. 4, 2018 by the United States Patent and Trademark Office in corresponding U.S. Appl. No. 15/427,467 (24 pages).

Notification of Transmittal of the International Search Report (Forms PCT/ISA/220 and PCT/ISA/210) and the Written Opinion of the International Searching Authority (Form PCT/ISA/237) dated May 14, 2018, by the Korean Intellectual Property Office in corresponding International Application No. PCT/US2018/015881 (15 pages).

* cited by examiner

FIG. 15
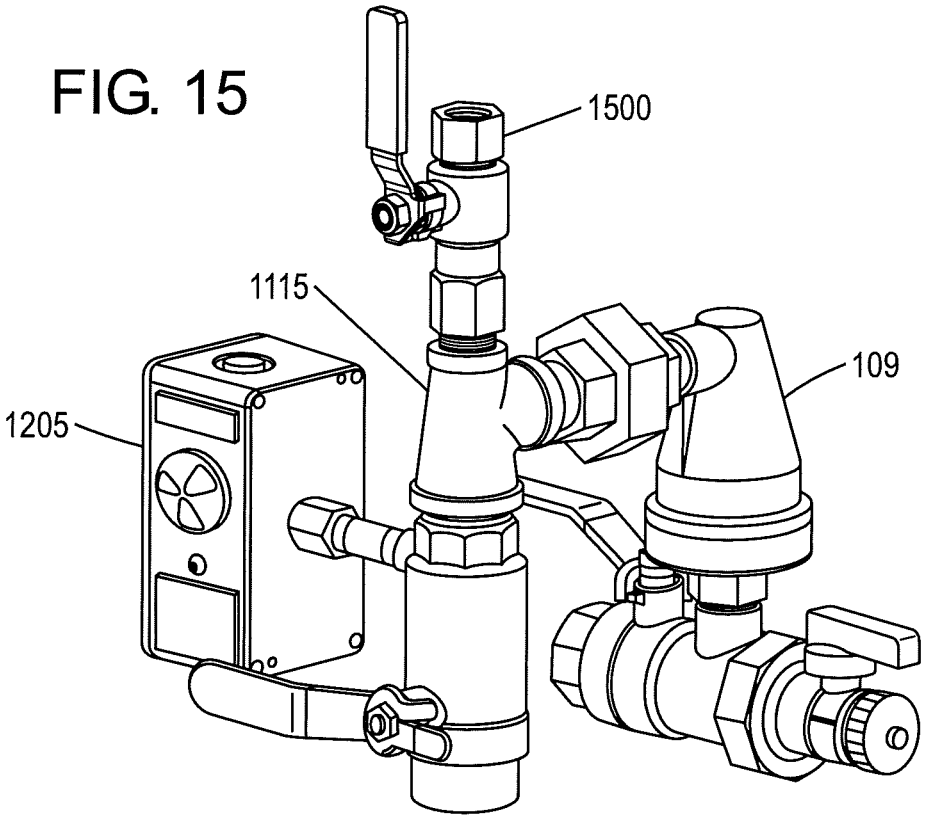
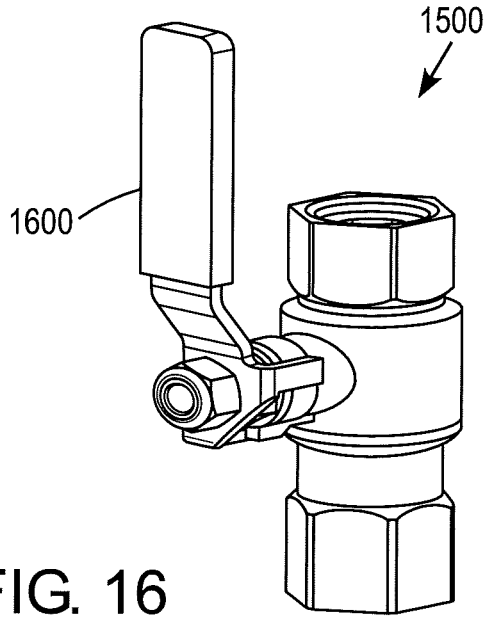
FIG. 16

PURGE AND VENT VALVE ASSEMBLY

RELATED APPLICATIONS

This application is a continuation-in-part of U.S. patent application Ser. No. 15/427,467.

TECHNICAL FIELD

The present disclosure relates to a valve assembly for a fire suppression sprinkler system that is configured to reduce and/or eliminate gas (e.g., air) that is present in the sprinkler system.

BACKGROUND

Fluid-based fire suppression sprinkling systems and the like often contain some amount of air in the system when in service. For example, air is introduced into the piping system when the system is installed, drained periodically to perform maintenance, or when making alterations to the pipe network. Some of this air remains trapped in the pipes when the pipes are refilled with fluid. Having trapped air in the pipes can be problematic because the trapped air can lead to corrosion inside of the pipes and by extension metal loss to the sprinkling system.

That is, one predominant form of corrosion to which fire suppression sprinkling systems are susceptible is oxygen corrosion. Oxygen is typically introduced into the sprinkling system in two ways. First, oxygen may be dissolved in the fluid used to fill the sprinkler pipes, such as fresh water. Second, any trapped air in the pipes will contain oxygen. Each time the sprinkling system is drained and refilled, the likelihood that oxygen corrosion will arise increases because of the introduction of a fresh supply of air into the piping network.

One technique for reducing the likelihood and/or amount of internal corrosion present in the piping system is to vent the piping network when the sprinkling system is filled or refilled. Venting the system may be performed manually or automatically with an air vent valve connected to the piping network. Such valves close after the air has been removed from the system to prevent the reintroduction of air into the piping system and to prevent any considerable amount of fluid in the pipes from being discharged through the air vent valve.

Existing valves for the removal of air from liquid-containing piping networks generally are formed from a plurality of individual components that are subsequently assembled together. These components may include float type vents. This often has the effect of increasing the size and cost of production of the valve. Accordingly, there exists a need to develop a compact, low-cost air release assembly for a wet pipe network that helps minimize and/or eliminate air present in the piping system.

Another problem that may arise when utilizing air venting components (e.g., piping and/or valves) in the piping system is the accumulation of moisture in the area around the vent. Specifically, air that is vented from a fire suppression sprinkling system often may contain a certain amount of moisture (i.e., the air is relatively moist). This moisture may condense and accumulate in the air venting components and their surroundings, which can promote corrosion in the former, and mold and the like in the latter.

There are known piping systems that utilize redundant air vent valves with a segment (e.g., a loop) of pipe between the redundant air vent valves. In some piping systems, the only indication of excessive moisture occurs when condensed water drips out of the system (e.g., through one of the air vent valves). When the moisture accumulation has reached this level, the air vent valves may be rendered inoperable and may need to be replaced. There are other systems where a pressure gauge is utilized to detect a pressure increase within the segment of pipe to alert an operator of possible moisture accumulation. These piping systems have drawbacks because the number of components and system complexity can increase cost both of the initial installation and maintenance of the piping system. Additionally, the volume of the moisture detection system may be relatively large. This can lead to arrangement and/or maintenance accessibility difficulties.

SUMMARY

The present disclosure provides a description of a valve assembly, an air vent assembly, and an air release assembly, all suitable for use in connection with a wet pipe network, or more specifically, all suitable for use in a fire suppression sprinkling system. The purge and vent valve assembly disclosed herein includes, but is not limited to, the PURGEnVENT® valve assembly. The present disclosure also discloses several embodiments of a moisture detection assembly to effectively detect moisture accumulation within the air release assembly (e.g., within the air release valve).

In one embodiment, the valve assembly includes a cylindrical member through which fluid may flow. The fluid may be introduced through an inlet of the cylindrical member and discharged through an outlet. The valve assembly includes a first valve disposed at the inlet and a second valve disposed at the outlet. A strainer may be provided in the valve assembly. An angled port may extend vertically from the cylindrical member and is connected with an air release valve.

In another embodiment, an air vent assembly includes a cylindrical chamber having an inlet, a main body with an enlarged cross-section, and an outlet. An angled port may be connected to the main body and extend vertically therefrom. The angled port also may include a portion which extends downwardly into an interior of the main body. The portion of the angled port captures air present in a fluid that is introduced into the cylindrical chamber when the piping network to which the air vent assembly may be attached is filled with the fluid. The air vent assembly may also include an air release valve that is connected to the angled port via an elbow.

In yet another embodiment, there is provided an air release assembly that includes a cylindrical chamber through which a fluid is flowed. The cylindrical chamber may be installed in a portion of a main line of a wet pipe system and includes an inlet, a main body with an enlarged cross-section, and an outlet. An angled port may be connected to the main body and extend downwardly into an interior of the main body. The portion of the angled port captures air present in a fluid that is introduced into the cylindrical chamber when the pipe network is filled with fluid. An elbow can be provided to connect the angled port to an air vent assembly. The air vent assembly includes a tubular member having an inlet and an outlet. A first valve is disposed at the inlet and a second valve is disposed at the outlet. A strainer may be provided in the air vent assembly. An angled port extends vertically from the tubular member and is connected with an air release valve.

BRIEF DESCRIPTION OF THE FIGURES

FIG. 15 illustrates a perspective view of an embodiment of a moisture detection assembly including a float relief valve connected to a valve assembly.

FIG. 16 illustrates a perspective view of the float relief valve according to an embodiment of the disclosure.

DETAILED DESCRIPTION

The devices described herein seek to provide a way of venting a gas (e.g., air nitrogen, etc.) remaining in a piping system when the system is filled with a fluid. More specifically, the devices here seek to minimize and/or eliminate the amount of air present in the pipe network of a fire sprinkling system when the pipes are filled with a fluid. Reducing and/or eliminating the amount of air in the piping network further has the effect of preventing and/or reducing the occurrence of corrosion of the pipes.

The devices described herein also relate to detecting moisture accumulation within the air venting portion of the piping system. The disclosed moisture detection assembly may be compact to minimize the volume of the piping system, which may improve the maintenance accessibility of the moisture detection assembly and allow for improved installation of the system (e.g., arrangement concerns are improved). The disclosed moisture detection assembly includes several alternative embodiments to facilitate reliable moisture detection in a variety of ways.

Depending on implementation, the devices described herein may conform to the requirements of National Fire Protection Association Standard 13 (NFPA 13). These devices also may be UL and/or FM compliant. The scope of the appended claims on the valve assembly, air vent assembly, air release assembly, and moisture detection assembly disclosed in this application, however, are not limited to conforming with any particular standards or requirements.

Figure 1:
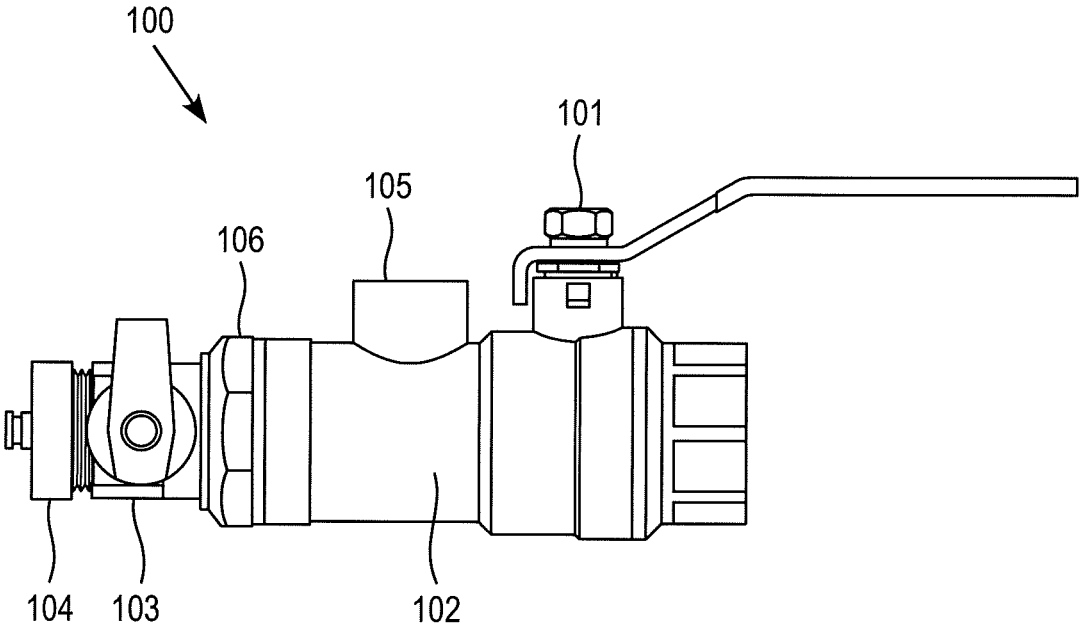
FIG. 1 illustrates a side view of a valve assembly according to an embodiment of the disclosure.

FIG. 1 depicts an exemplary valve assembly 100 suitable for installation in a wet pipe system for removing residual air (or another gas) from the pipe system. Valve assembly 100 may be disposed at a selected end of the line in a piping network. The valve assembly may be installed at the end of each line of a multiline system. These can be used for the purposes of flushing or purging the air contained within the pipe system.

Valve assembly 100 may include a ball valve 101. The ball valve 101 may be an integrated ball valve which facilitates access to an air release valve (with or without a strainer) for servicing. The ball valve 101 attaches either directly or indirectly to the end of the line of the pipe system. An exemplary ball valve may be UL 258 compliant. Valve assembly 100 may include a stainless steel strainer 102, which may be disposed adjacent (e.g., in the direction of fluid flow) to the integrated ball valve 101 as illustrated in FIG. 1. Strainer 102 (e.g., a stainless steel strainer screen) is designed to help remove particulate matter flowing through the valve assembly 100. Strainer 102 helps prohibit the particulate matter above the size of the passages in the strainer (e.g., screen aperture size) from flowing into an attached air release valve 109 (e.g., illustrated in FIG. 4), thus protecting the integrity and lifespan of the air release valve 109. Attached to the strainer 102 may be an angled port 105 that extends from a main body portion of the valve assembly 100 in this exemplary embodiment.

Figure 4:
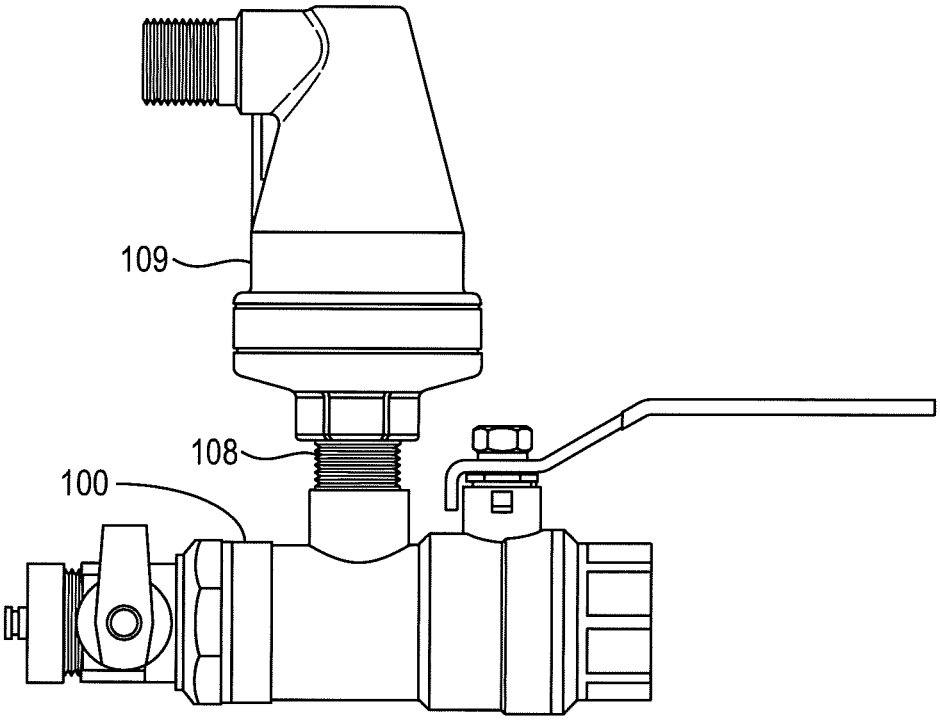
FIG. 4 illustrates a side view of a valve assembly according to an embodiment of the disclosure.

As shown in FIG. 1, for example, the angled port 105 may extend vertically from the main body portion of the valve assembly 100. It is generally configured such that the angled port 105 extends vertically from the main body portion of the valve assembly 100 to direct air to an air release valve 109 positioned vertically above the main body portion of the valve assembly 100. The angled port may facilitate proper orientation of an attached air release valve without the need for additional fittings or connectors. In some embodiments, the angled port 105 may be formed as a right angle as shown in FIGS. 1, 4. In other embodiments, the angled port may be extend from the main body of the valve assembly 100 at another angle (e.g., at an angle other than directly vertically upward) to vent gas (e.g., air) remaining in the piping system.

Attached to the main body portion of the valve assembly 100 is a purge valve 103. The purge valve 103 has a hose connection that permits an easy direct connect with a hose attachment in this exemplary embodiment. This allows the purge valve 103, and the valve assembly 100, to be easily purged of fluid and/or gas (e.g., air) in the pipe system to which the valve assembly 100 is attached through a detachable garden hose or the like into an appropriate receptacle. The purge valve 103 includes exterior threaded end at an outlet end, to which a threaded cap 104 (i.e., a removable cap) may be threadingly engaged. The threaded cap 104 may be attached to the valve assembly 100 by way of a lanyard. The threaded cap 104 helps protect the threading of the purge valve 103 from damage and may reduce dripping in the event that there is leakage through the valve. The purge valve 103 is adjustably connected to the valve assembly 100 via an adjustable connection 106 such that the orientation of the purge valve 103 may be easily adjusted during or after installation of the valve assembly 100.

A hose may be connected to the purge valve 103, which is connected with the pipe network, for venting an amount of air and some liquid in the pipes. Upon opening the purge valve 103, air is pushed out through the end of the line as a fluid (e.g., water and/or another fire suppressant) fills the system. The purge valve 103 is typically only opened to purge air via the hose connection when the piping system is being initially filled with the fluid or when the strainer 102 needs to be flushed. After the fluid fills the system, the purge valve 103 is closed and residual gas (e.g., air) is vented through the air release valve 109. More specifically, any air remaining in the pipe system that is not purged via the hose connection with the purge valve 103 may be vented from the valve assembly 100 through the angled port 105 and into the air release valve 109 (described below) for venting.

Figure 2:
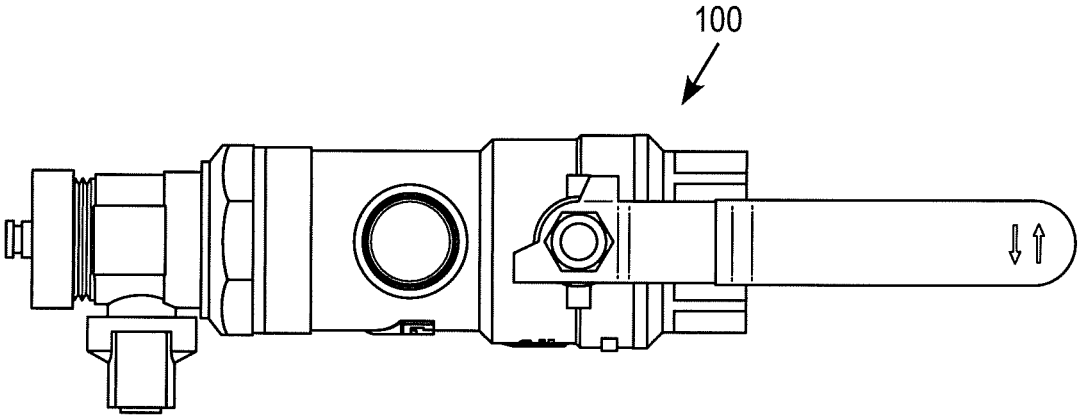
FIG. 2 illustrates a top view of an exemplary valve assembly.

FIG. 2 illustrates a top view of the valve assembly illustrated in FIG. 1.

Figure 3:
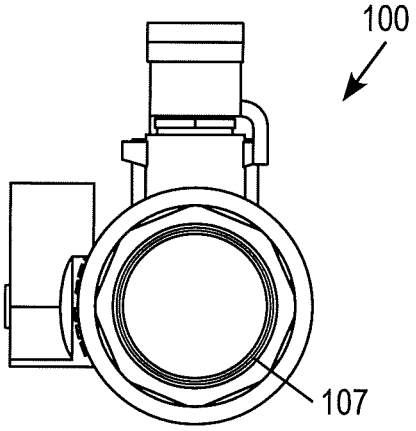
FIG. 3 illustrates a front view of an inlet of an exemplary valve assembly.

FIG. 3 is another view of the valve assembly illustrated in FIG. 1. FIG. 3 depicts an inlet 107 of the valve assembly, which may be formed as a portion of the ball valve 101. In one exemplary embodiment, inlet 107 may have a 1" thread taper (1" NPT).

FIG. 4 illustrates another embodiment of an exemplary valve assembly in accordance with the present disclosure. In this example, a pipe nipple 108 is connected to the angled port of valve assembly 100. Attached to the other end of the pipe nipple 108 is an exemplary air release valve 109. The air release valve 109 utilizes a weighted float connected to a spring loaded valve. When no water is present the weight of the float pulls down on the spring and opens the exit port. As water is introduced to its internal chamber, the water lifts the float and causes the spring to close the exit port.

The purge valve 103, the strainer 102, the angled port 105, and the ball valve 101 preferably form a unitary valve assembly structure (e.g., the housing or body of the valve assembly 100 may include/house all four of these components). Forming the valve assembly as a unitary structure permits the overall sizing of the valve assembly to be reduced as compared with existing valve assemblies that are assembled from a combination of individual components. The valve assembly body may be corrosion resistant and may be manufactured from forged brass rated for 300 PSI service, for example, which is useful in some commercial sprinkler systems.

Figure 5:
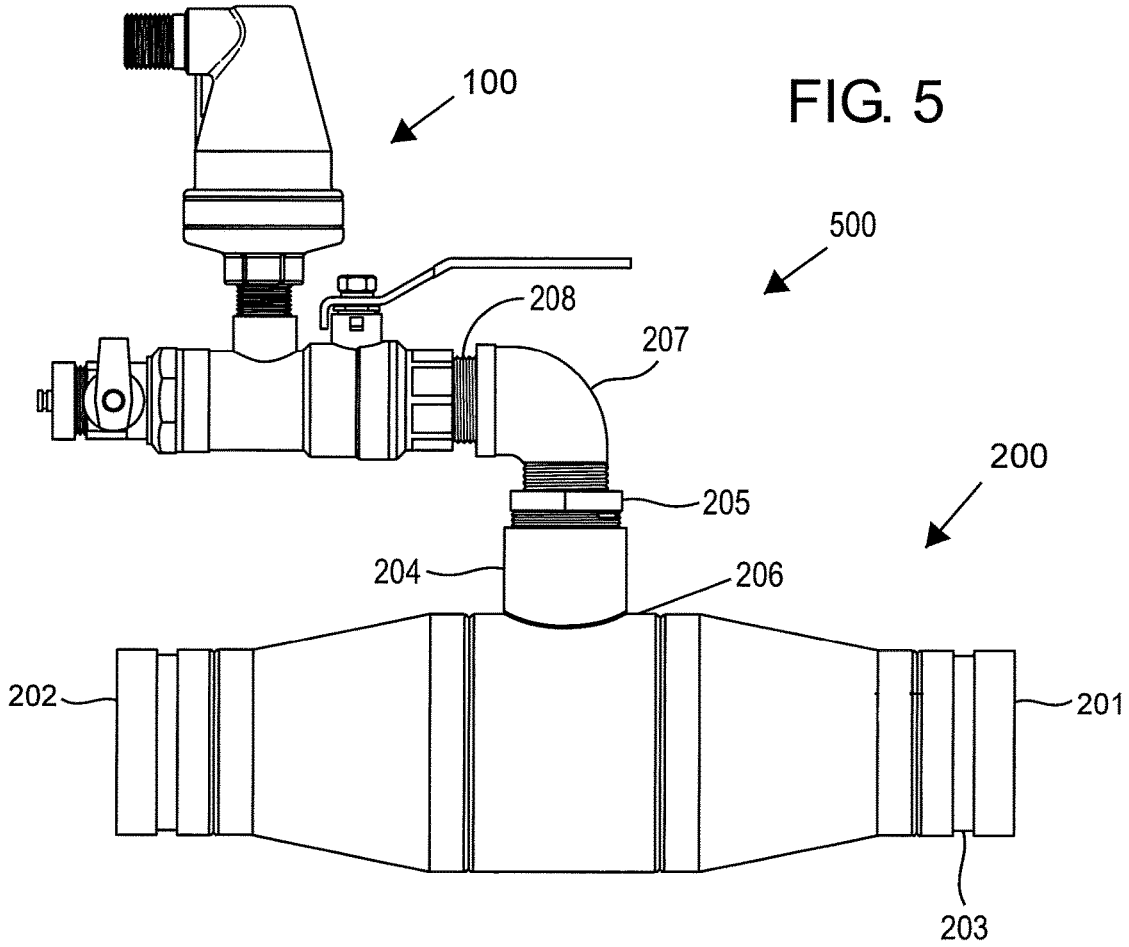
FIG. 5 illustrates a side view of an air release assembly according to an embodiment of the disclosure.
Figure 6:
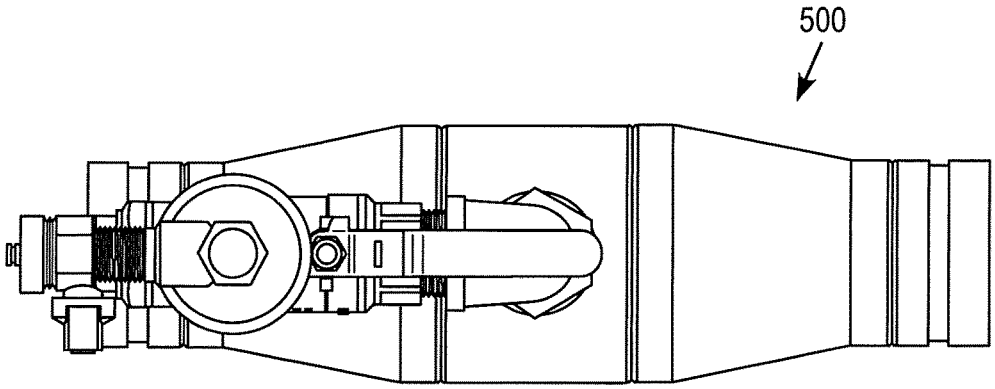
FIG. 6 illustrates a top view of an exemplary air release assembly.
Figure 7:
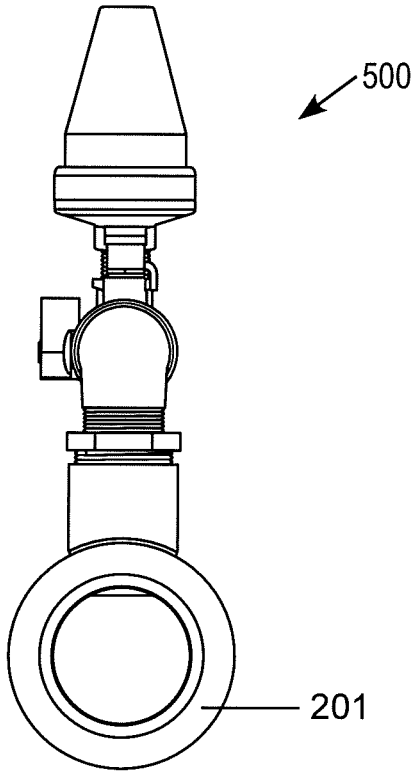
FIG. 7 illustrates a front view of an air release assembly according to an embodiment of the disclosure.

FIG. 5 depicts an exemplary air release assembly 500 suitable for installation in a main line of a wet pipe system. FIG. 6 depicts a top view of the air release assembly of FIG. 5, and FIG. 7 depicts a front view of the air release assembly (e.g., when viewed from the inlet side 201).

As illustrated in FIG. 5, air release assembly 500 may include valve assembly 100 and air vent assembly 200. It is contemplated that the air release assembly 500 may be positioned at any point along the pipe line. In one embodiment, the air release assembly 500 is positioned at the beginning of the pipe line, e.g., in proximity or adjacent to an inspector's test valve. The air release assembly 500 permits the purging of air during an initial fluid fill of the system (e.g., via purge valve 103) and includes a small inner diameter conduit/path from, for example, a high point in the main body of the air vent assembly 200 for air to migrate for venting following the system fill. As described hereafter, the air release assembly 500 provides an enlarged chamber in the piping system that may effectuate a small pressure drop resulting from an increased area followed by a restriction which pushes a fluid in the system forward yet keeps air in the chamber.

Air vent assembly 200 includes a cylindrical chamber having a main body and opposing first and second ends. The first end may be an inlet 201 of the air vent assembly 200, and the second end may be an outlet 202 of the air vent assembly 200. Alternatively, the first end may be an inlet 202 of the air vent assembly 200 and the second end may be an outlet 201 of the air vent assembly 200. One or both of the first and second ends of the air vent assembly may include grooved ends 203 that facilitate a simple and quick connection with a line of the pipe network (e.g., via a quick-connect coupling).

Figure 8:
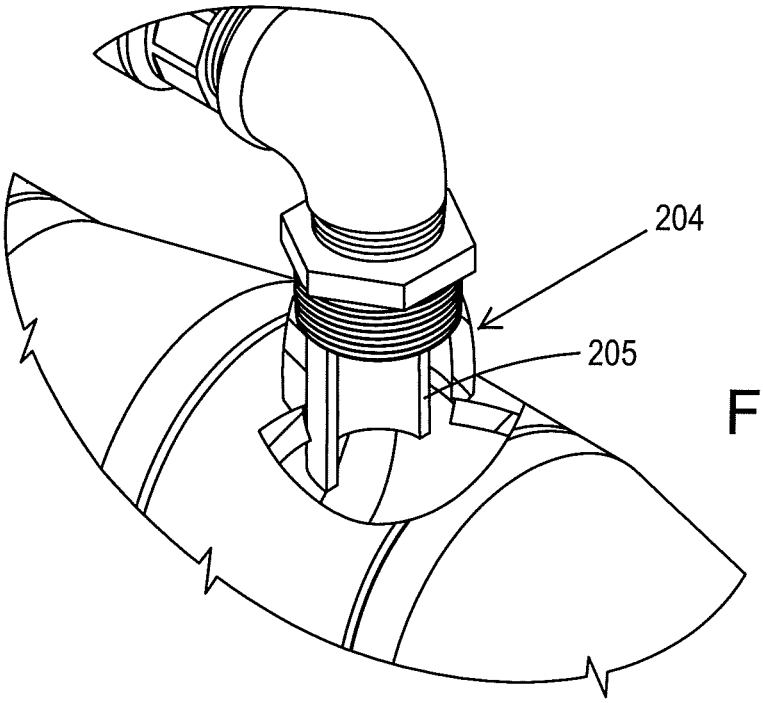
FIG. 8 illustrates an isometric view of an air vent assembly according to an embodiment of the disclosure.

An angled port 204 may be connected to the main body of the air vent assembly 200 and extends vertically therefrom. As shown in FIG. 8, the angled port 204 includes a portion 205 (hereinafter referred to as an air scoop 205) that extends downwardly into the interior of the main body of the air vent assembly 200. The air scoop 205 can form a separation chamber 206 with the main body of the air vent assembly 200. The separation chamber 206 may capture air (or other gas) present in the fluid introduced through the air vent assembly when the piping network is filled with a fluid. The separation chamber 206 can create a natural high spot for air to collect and be directed through to the attached valve assembly 100 for subsequent venting therefrom.

The air scoop 205 may act as a bubble collector. The air scoop 205 may assist to help ensure that the maximum amount of air present in the fluid in the air vent assembly 200 is captured/vented when the piping system is filled (or flushed) with the fluid. The air scoop 205 may also be configured to minimize the amount of fluid head loss during a fire suppression event. The air scoop 205 may be formed of cast bronze for increased durability. The air scoop 205 could also be formed of another material, such as plastic or machined brass. As shown in FIG. 8, the air scoop 205 may be a semi-cylindrical body (e.g., a half-cylinder) that includes a concave surface facing the inlet 201 of the air vent assembly 200 and a convex surface facing the outlet 202 of the air vent assembly 200. The air scoop 205 is discussed in more detail below in reference to FIGS. 9 and 10.

The air vent assembly 200 may also include an elbow 207 that connects to the angled port 204. In the embodiment illustrated in FIG. 5, the elbow 207 connects to the air scoop 205, which in turn is connected to the angled port 204. A pipe nipple 208 may connect the other end of the elbow 207 to the valve assembly 100.

FIG. 7 shows another view of the air release assembly illustrated in FIG. 5. FIG. 7 depicts an inlet 201 of the air vent assembly.

The main body and the angled port 204 of the air vent assembly 200 can be formed as a unitary structure. Forming the air vent assembly as a unitary structure can permit the overall sizing of the vent assembly to be reduced as compared with existing air vent structures that are typically assembled from a combination of individual components. The main body of the air vent assembly 200 may have an enlarged cross-section relative to the cross-section of the inlet 201 and outlet 202 of the air vent assembly 200 (i.e., the inner diameter of the main body of the air vent assembly 200 is greater than the inner diameter at the inlet 201 and the outlet 202 of the air vent assembly 200). As stated above, the enlarged chamber can result in a small pressure drop that pushes the fluid in the system forward while keeping air in the chamber.

The air vent assembly cylindrical chamber can be powder coated safety red or another color. This facilitates corrosion resistance and easy visibility.

Additionally, the air vent assembly may be provided in varying sizes. For example, the air vent assembly may be 2-inches, 2.5-inches, 3-inches, or 4-inches in nominal pipe diameter for inlet 201 and/or outlet 202, as some examples, though the size would be dependent on the overall system or installation.

Figure 9:
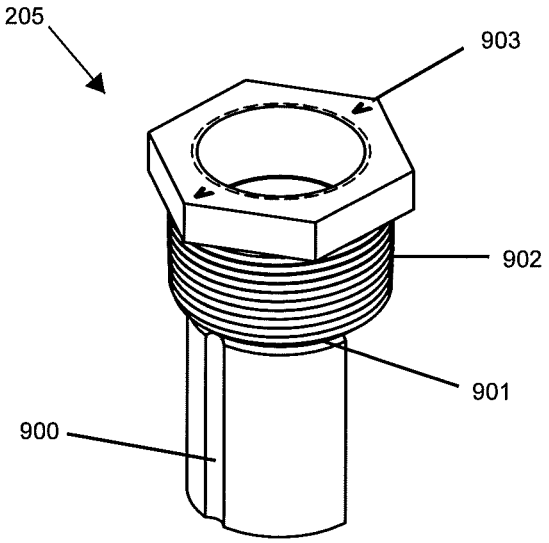
FIG. 9 illustrates a perspective view of an air scoop according to an embodiment of the disclosure.
Figure 10:
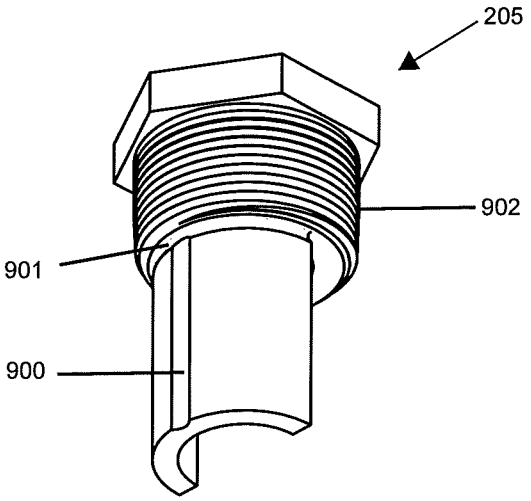
FIG. 10 illustrates a view of the air scoop shown in FIG. 9 from another perspective.

An embodiment of the air scoop 205 is shown in FIGS. 9 and 10. As illustrated in FIGS. 9 and 10, the air scoop 205 may include a vertical channel 900 on the convex surface which faces the outlet 202 (i.e., the outer surface downstream in the fluid flow path) when the air scoop 205 is installed in the air vent assembly 200. The vertical channel 900 may extend from the bottom edge of the convex surface upwards to a horizontal channel 901 at the top portion of the convex surface. The horizontal channel 901 may be located immediately beneath to the pipe threads 902 of the air scoop 205. The vertical channel 900 and/or horizontal channel 901 are positioned on the downstream convex surface of the air scoop 205 in order to aid in faster elimination of air bubbles that form immediately downstream of the air scoop 205. The vertical channel 900 and the horizontal channel 901 thus provide a pathway for the small amount of air which may collect downstream of the air scoop 205 to help ensure that all air bubbles are removed from the air vent assembly 200.

The vertical channel 900 and the horizontal channel 901 could also be configured in other ways than the configuration shown in FIGS. 9 and 10. For example, multiple vertical channels 900 and/or horizontal channels 901 could be included, and the channels 900 and 901 could be configured to extend at a different orientation or for a different length. Although multiple vertical channels would not typically be necessary, it is possible that additional vertical channels 900 would be beneficial if the air scoop 205 was improperly installed (e.g., if the air scoop 205 were over-rotated or under-rotated relative to the main body of the air vent assembly 200 during installation). Other channel configurations are also possible. For example, the air scoop 205 could possess a channel that is chevron-shaped, spiral-shaped, circular-shaped, etc.

FIG. 9 also illustrates that one embodiment of the air scoop 205 includes a flow directional indicator 903. The flow directional indicator 903 may include arrows to illustrate the intended direction of fluid (e.g., water) flow, for example, to facilitate proper installation of the air scoop 205. The flow directional indicator 903 may be, for example, stamped or cast into the top of the air scoop 205. Other types of flow directional indicators 903 may also be utilized in the system.

Figure 11:
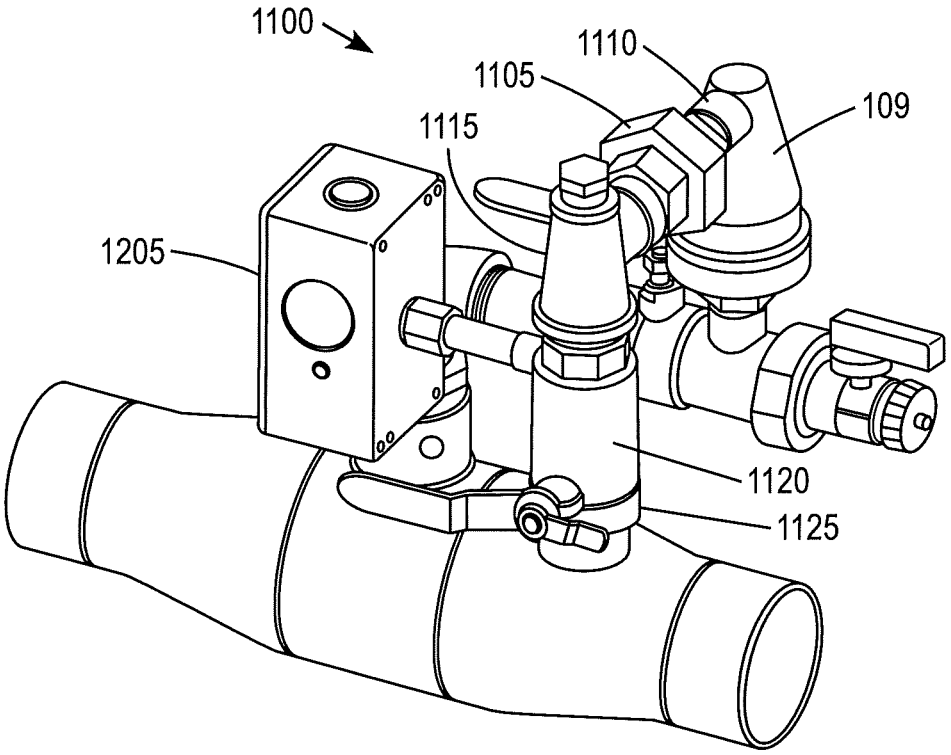
FIG. 11 illustrates a perspective view of a moisture detection assembly connected to the air vent release assembly according to an embodiment of the disclosure.

In some embodiments, the air release assembly 500 may include a moisture detection assembly 1100. As illustrated in FIG. 11, the moisture detection assembly 1100 may be directly connected to a threaded connection of the air release valve 109 of the valve assembly 100. The moisture detection assembly 1100 may include a mating nut 1105 to connect an angled outlet port 1110 of the air release valve 109 to an inlet port of the condensate chamber 1115. This compact configuration of components can direct moist air from the air release valve 109 into the condensate chamber 1115.

Figure 12:
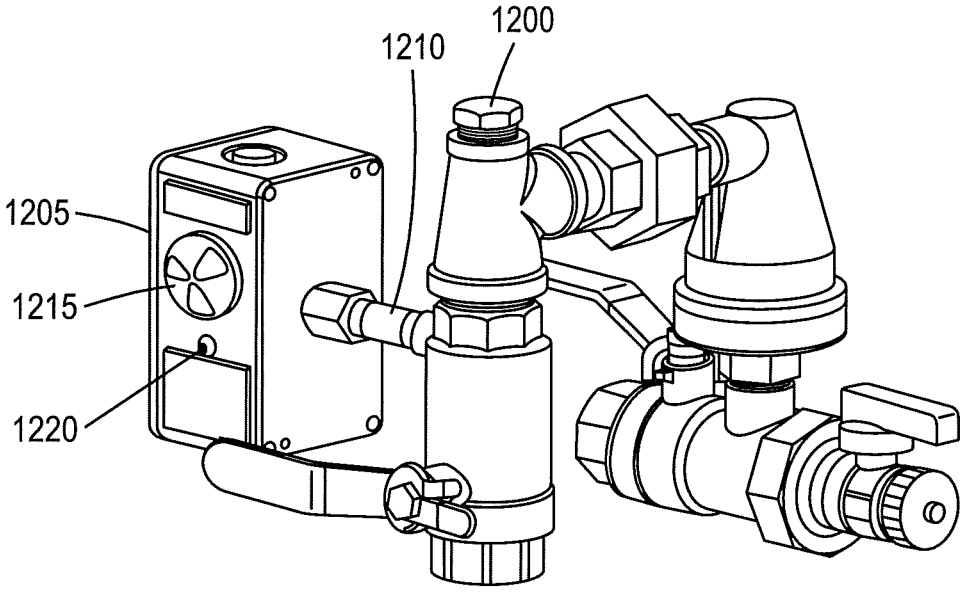
FIG. 12 illustrates a perspective view of a moisture detection assembly connected to a valve assembly according to an embodiment of the disclosure.
Figure 13:
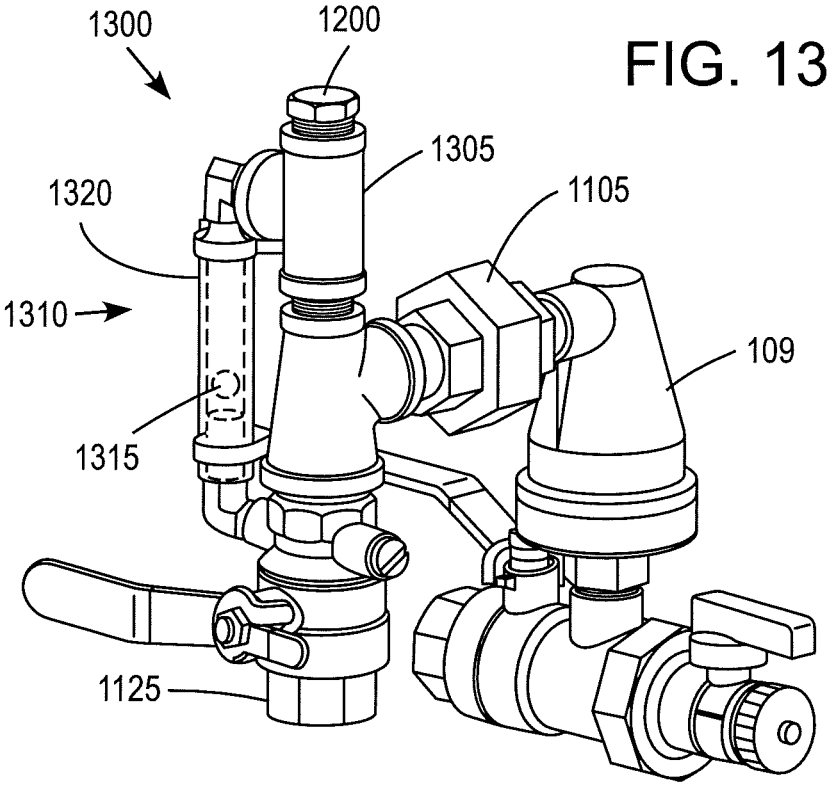
FIG. 13 illustrates a perspective view of another embodiment of a moisture detection assembly connected to a valve assembly.

The condensate chamber 1115 may possess a truncated conical shape as illustrated in FIGS. 11-13, although other forms are also contemplated. The condensate chamber 1115 is thus configured to direct condensate downwards into a moisture collection tank 1120. The moisture collection tank 1120 may be cylindrical as shown in FIGS. 11 and 12, or the moisture collection tank 1120 may be nearly any other shape. The moisture collection tank 1120 includes a drain valve 1125 that allows accumulated moisture to be released/dispelled from the moisture collection tank 1120. During operation, the drain valve 1125 is typically maintained in the closed position. When an operator receives an indication that the moisture accumulation has reached a certain level (as discussed below), the operator may open the drain valve 1125 to release the accumulated moisture (alternatively, an automatic valve may be utilized so that user operation is not required). Any type of receptacle (e.g., a cup or drain pan) can be used to capture the moisture released in this process or the moisture can be released by a drain tube or any other means that one of ordinarily skill in the art would readily employ. Additionally, the drain valve 1125 may be a ball valve or any other suitable manually or automatically operated valve for releasing the accumulated moisture.

As illustrated in FIG. 12, the condensate chamber 1115 may include a vent screen 1200 at the upper-most end of the condensate chamber 1115. The vent screen 1200 can be mesh or any type of material with perforations allowing the outer environment to be in communication with the interior of the condensate chamber 1115. Air may thus be released from the condensate chamber 1115 through the vent screen 1200 during operation. The vent screen 1200 may include perforations that are sufficiently small in diameter to prevent foreign objects of a size that might singly or cumulatively cause problems from entering the condensate chamber 1115.

FIGS. 11 and 12 also illustrate that some embodiments of the moisture detection assembly 1100 may include a condensate alarm 1205. The condensate alarm 1205 may include an electronic moisture-sensing probe that detects condensate/moisture. The condensate alarm 1205 may be battery-powered or may be connectable to an electrical source (e.g., low voltage, line voltage (with a transformer), etc.). The moisture-sensing probe may extend into the interior of the moisture collection tank 1120 or the interior of the moisture collection tank 1120 may be in communication with the moisture sensing-probe via the horizontal connection 1210.

The condensate alarm 1205 may be configured to emit an audio and/or visual alarm upon the detection of condensate/moisture. The condensate alarm 1205 illustrated in FIG. 12 includes a speaker 1215 to emit an audio alarm when condensate/moisture is detected by the moisture-sensing probe. The condensate alarm 1205 shown in FIG. 12 also includes a light-emitting diode (LED) 1220 that may light up and/or blink repeatedly when condensate/moisture is detected to provide a visual indication of the moisture accumulation. In some embodiments, the condensate alarm 1205 could include only audio or visual indication. The condensate alarm 1205 could also include a plurality of speakers and/or a plurality of visual indicators (e.g., LEDs) to alert the system operators of the moisture accumulation. In another embodiment, the condensate alarm 1205 could be configured to communicate (e.g., electronically) with a remote control panel to provide an audio and/or visual alarm at another location.

FIG. 13 illustrates another embodiment of a moisture detection assembly 1300. This embodiment of the moisture detection assembly 1300 also includes a connection to the air release valve 109, a condensate chamber 1115, a moisture collection tank 1120, and a drain valve 1125. The size and position of these components may be different than the similar components in the embodiment of the moisture detection assembly 1100 shown in FIGS. 11 and 12, but these components function in a similar manner. Therefore, the description of these components will not be repeated here.

The moisture detection assembly 1300 may include a T-shaped pipe fitting 1305 connected to the upper end of the condensate chamber 1115. The vent screen 1200 may thus be connected to the upper end of the T-shaped pipe fitting 1305 as shown in FIG. 13. The angled port of the T-shaped pipe fitting 1305 may be connected to the upper end of the float level assembly 1310. The lower end of the float level assembly 1310 may be directly connected to the moisture collection tank 1120 (in some embodiments, the moisture collection tank 1120 could be omitted and the condensate chamber 1115 could also function as the moisture collection tank 1120).

The float level assembly 1310 thus directly communicates with the moisture collection tank 1120 (or the condensate chamber 1115), so that moisture/condensate fills the bottom portion of the float level as the moisture accumulates. The float level assembly 1310 includes a float 1315 that rises within a transparent tube 1320 as the moisture/condensate level increases. The float 1315 thus provides a visual indication to an operator (e.g., an operator at ground level) of the level of moisture/condensate in the moisture collection tank 1120. In some embodiments, the tube 1320 may not be entirely transparent. The float 1315 must be visible, however, to alert the operator of the moisture content.

Figure 14:
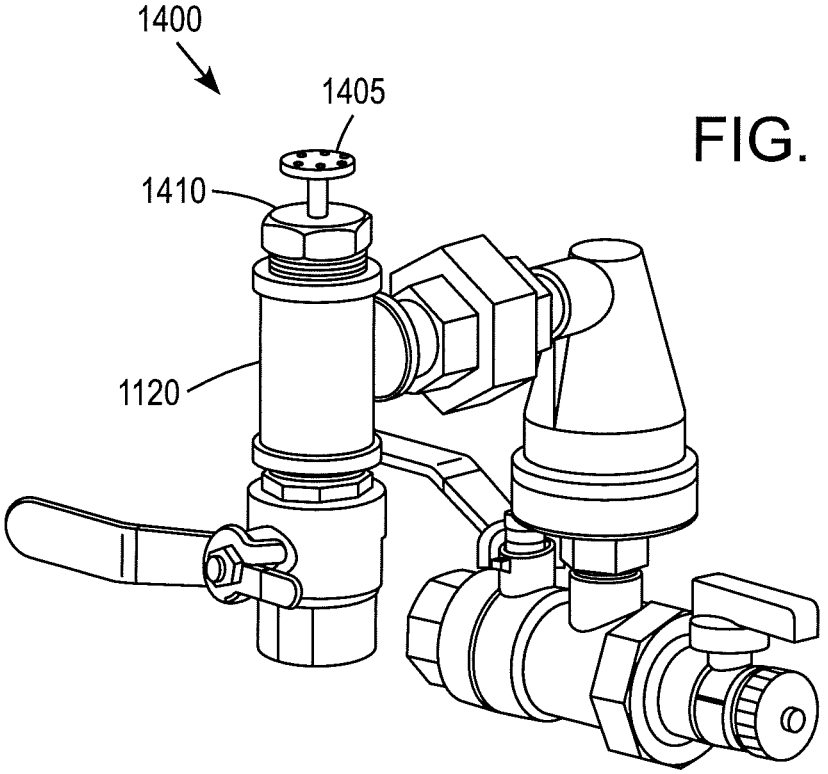
FIG. 14 illustrates a perspective view of another embodiment of a moisture detection assembly connected to a valve assembly.

FIG. 14 illustrates another embodiment of a moisture detection assembly 1400. This embodiment of the moisture detection assembly 1400 also includes a connection to the air release valve 109, a moisture collection tank 1120, and a drain valve 1125. The size and position of these components may be different than the similar components in the embodiment of the moisture detection assembly 1100 shown in FIGS. 11 and 12, but these components function in a similar manner. Therefore, the description of these components will not be repeated here.

The moisture detection assembly 1400 shown in FIG. 14 also provides visual indication to alert an operator of the moisture level. The moisture detection assembly 1400 may include only the moisture collection tank 1120 and omit the condensate chamber 1115 shown in the FIGS. 11-13 embodiments. The moisture detection assembly 1400 includes a pop-up indicator float 1405. The pop-up indicator float 1405 may extend upward beyond the upper end of the moisture collection tank 1120. The pop-up indicator float 1405 may include a float component within the moisture collection tank 1120 that rises/floats upwards in accordance with a rising moisture/condensate level within moisture collection tank 1120. The pop-up indicator float 1405 thus "pops-up" or rises vertically upwards to reflect the moisture level within the tank. The pop-up indicator float 1405 may be brightly colored or possess some other visually distinguishing characteristics so that an operator can readily view the pop-up indicator float 1405 from ground level.

The moisture detection assembly 1400 may include a vent screen 1410 attached to the upper end of the moisture collection tank 1120. The vent screen 1410 may contain perforations similar to the vent screen 1200 discussed above, but the vent screen 1410 in FIG. 14 also includes a central hole that the pop-up indicator float 1405 passes through so that the pop-up indicator float 1405 can extend vertically beyond the vent screen 1410.

FIG. 15 illustrates an embodiment of the moisture detection assembly 1100 that includes a float relief valve 1500. The moisture detection assembly 1100 shown in FIG. 15 contains the same features as the moisture detection assembly 1100 illustrated in FIGS. 11 and 12. However, the float relief valve 1500 can also be utilized with the moisture detection assemblies 1300 shown in FIG. 13, respectively or in any variations of the assemblies discussed above.

As shown in FIG. 15, the float relief valve 1500 may be directly connected to the upper end of the condensate chamber 1115. These two components may be threadedly-fitted directly to one another or may be connected by utilizing a typical pipe fitting. The float relief valve 1500 is illustrated in more detail in FIGS. 16-17.

The float relief valve 1500 shown in FIG. 16 is a manually-operated ball valve. Specifically, the lever 1600 may be manually rotated to open/shut flow through the float relief valve 1500. The float relief valve 1500 is typically maintained in the open position during initial fill and during refills, and is then left in the open position when the piping system is operable.

Figure 17:
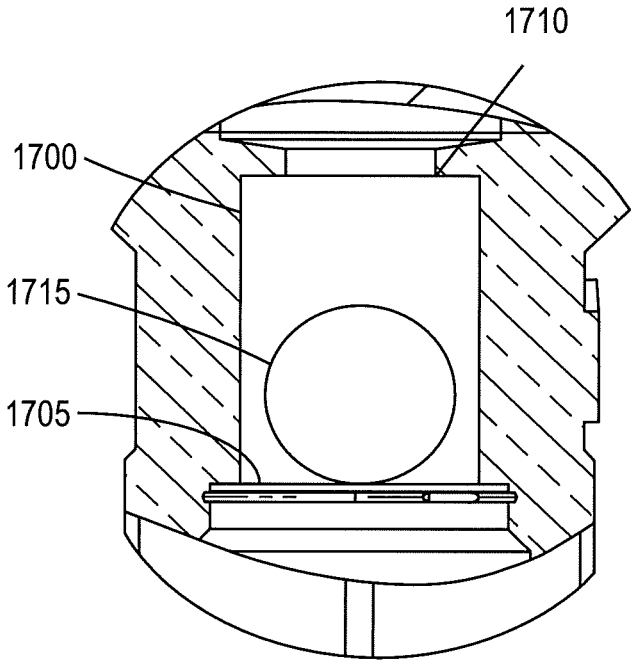
FIG. 17 illustrates a cross-sectional schematic view of a float within the float relief valve according to an embodiment of the disclosure.

As illustrated in FIG. 17, the float relief valve 1500 includes an internal chamber 1700. The internal chamber 1700 is an open cylindrical chamber between an inlet screen 1705 and an upper float seat 1710. The internal chamber 1700 may be immediately below the manual ball valve in the vertical direction as shown in FIGS. 16-17. The internal chamber 1700 of the float relief valve 1500 houses a float component 1715. The float component 1715 may be positioned on the inlet screen 1705 of the internal chamber 1700 before the piping system is brought into service. During the initial filling of the piping system with, for example, a fire suppression liquid, the float component 1715 may allow residual air to bleed past the float component and through the top opening of the float relief valve 1500. In other words, the float component 1715 is configured so that air is allowed to pass around the float component 1715 to exit the internal chamber 1700 of the float relief valve 1500.

During the initial filling process, however, liquid (e.g., water) may be introduced into the float relief valve 1500. The float component 1715 will be urged vertically upwards by the liquid to seat on the upper float seat 1710 at the top end of the internal chamber 1700. The float component 1715 will thus seal the internal chamber 1700 of the float relief valve 1500 so that the liquid will not exit the float relief valve 1500. When the piping system is in a static operational state, the float relief valve 1500 should be in the open position.

Figure 18:
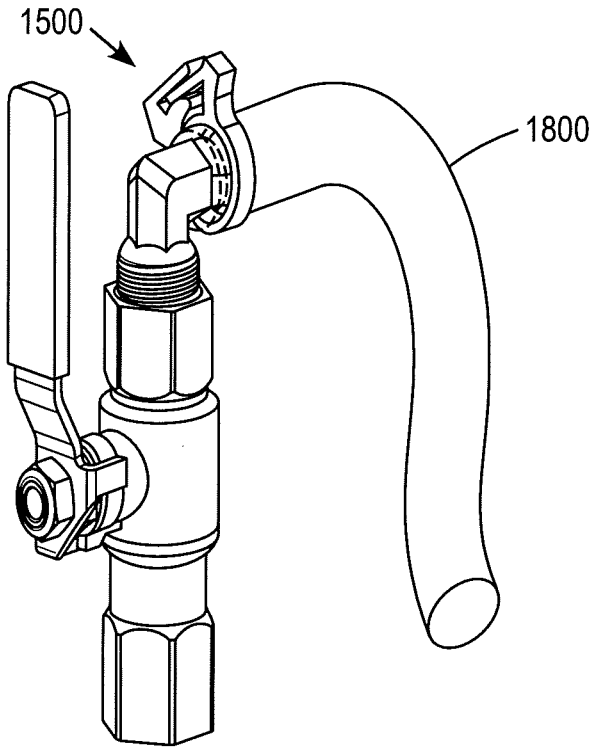
FIG. 18 illustrates a perspective view of the float relief valve connected to a drain tube according to an embodiment of the disclosure.

In the embodiment illustrated in FIG. 18, the float relief valve 1500 is connected to an open-ended drain tube 1800. The open-ended drain tube 1800 may be utilized in an air venting or "burping" process. For example, when liquid fills the internal chamber 1700 and causes the float component 1715 to seat against the upper float seat 1710, there may be a residual amount of air that remains in the internal chamber 1700. This air may be released (e.g., "burped") from the system by operating the manual ball valve. When the position of the manual ball valve is changed, the ball valve is positioned to contact the float component 1715 to push the float component 1715 away from the upper float seat 1710. This unseating movement allows for a small amount of residual air, as well as some amount of liquid, to be released (e.g., "burped") from the system. The open-ended drain tube 1800 thus may be helpful during this "burping" process, so that any liquid released is readily collected by, for example, a receptacle such as a cup or pan.

While various exemplary embodiments of the disclosed system and method have been described above it should be understood that they have been presented for purposes of example only, not limitations. It is not exhaustive and does not limit the disclosure to the precise form disclosed. Modifications and variations are possible in light of the above teachings or may be acquired from practicing of the disclosure, without departing from the breadth or scope.

What is claimed is:

1. A valve assembly comprising:

a cylindrical member through which a fluid is configured to flow, the cylindrical member having two opposing ends, one end being an inlet through which the fluid is introduced and the other end being an outlet through which the fluid is discharged, the cylindrical member extending linearly between the inlet and the outlet in an axial direction, the cylindrical member having a middle portion between the inlet and the outlet;

a first valve disposed at the inlet of the cylindrical member such that when the fluid flows through the cylindrical member, the fluid is first introduced through the first valve;

a strainer configured to remove particulate matter from the fluid when the fluid flows through the inner chamber, the strainer being within the cylindrical member;

an angled port that extends from the middle portion of the cylindrical member transverse to the axial direction, the angled port being a hollow tubular member;

an air release valve connected to the angled port; and a second valve directly connected to the outlet of the cylindrical member such that the fluid in the cylindrical member is dischargeable through the second valve via a flow path in the axial direction through the first valve and out from the second valve, wherein the cylindrical member, the first valve, the strainer, the angled port, and the second valve are housed in one body.

2. The valve assembly of claim 1, wherein the first valve is an integrated ball valve.

3. The valve assembly of claim 1, wherein the second valve is a purge valve having a hose connection.

4. The valve assembly of claim 1, wherein the air release valve is connected to the angled port via a pipe nipple.

5. The valve assembly of claim 1, wherein the air release comprises an outlet port that discharges gas directly to an outer environment.

6. A valve assembly comprising:

a cylindrical member through which a fluid is configured to flow, the cylindrical member having two opposing ends, one end being an inlet through which the fluid is introduced and the other end being an outlet through which the fluid is discharged, the cylindrical member extending linearly between the inlet and the outlet in an axial direction, the cylindrical member having a middle portion between the inlet and the outlet;

a first valve disposed at the inlet of the cylindrical member such that when the fluid flows through the cylindrical member, the fluid is first introduced through the first valve;

a strainer configured to remove particulate matter from the fluid when the fluid flows through the inner chamber, the strainer being within the cylindrical member;

an angled port that extends from the middle portion of the cylindrical member transverse to the axial direction, the angled port being a hollow tubular member;

an air release valve connected to the angled port; and a second valve directly connected to the outlet of the cylindrical member such that the fluid in the cylindrical member is dischargeable through the second valve via a flow path in the axial direction through the first valve and out from the second valve, wherein the air release valve comprises an outlet port, and the valve assembly further comprises:

a condensate collection chamber connected to the outlet port of the air release valve, the condensate collection chamber comprising a vent screen and being configured to condense and retain moisture within the condensate collection chamber; and a moisture detection device that communicates with the condensate collection chamber, the moisture detection device being configured to detect moisture.

7. The valve assembly of claim 6, wherein the moisture detection device is selected from a group consisting of an electronic moisture detection sensor, a float level and transparent tube assembly, and a pop-up indicator float.

8. The valve assembly of claim 7, wherein the condensate collection chamber comprises a truncated conical-shaped body and a cylindrically shaped tank, the truncated conical-shaped body being connected to the cylindrically shaped tank and positioned directly vertically above the cylindrically shaped tank, and the valve assembly further comprises a drain valve at a lower end of the cylindrically shaped tank, the drain valve being operable to release the moisture collected in the condensate collection tank.

9. A valve assembly comprising:

a cylindrical member through which a fluid is configured to flow, the cylindrical member having two opposing ends, one end being an inlet through which the fluid is introduced and the other end being an outlet through which the fluid is discharged;

a first valve disposed at the inlet of the cylindrical member such that when the fluid flows through the cylindrical member, the fluid is first introduced through the first valve;

a strainer configured to remove particulate matter from the fluid when the fluid flows through the inner chamber, the strainer being within the cylindrical member;

an angled port that extends from the cylindrical member;

an air release valve connected to the angled port, the air release valve comprising an outlet port;

a second valve disposed at the outlet of the cylindrical member such that the fluid in the cylindrical member is dischargeable through the second valve;

a condensate collection chamber connected to the outlet port of the air release valve, the condensate collection chamber comprising a vent screen and being configured to condense and retain moisture within the condensate collection chamber;

a moisture detection device that communicates with the condensate collection chamber, the moisture detection device being configured to detect moisture;

the condensate collection chamber comprising a truncated conical-shaped body and a cylindrically shaped tank, the truncated conical-shaped body being connected to the cylindrically shaped tank and positioned directly vertically above the cylindrically shaped tank;

a drain valve at a lower end of the cylindrically shaped tank, the drain valve being operable to release the moisture collected in the condensate collection tank;

a float relief valve connected to an upper-most end of the truncated conical-shaped body;

the float relief valve comprising an internal chamber, a float, and a float seat;

the float relief valve being configured to remain open when air passes through the float relief valve with the float being spaced apart from the float seat within the internal chamber; and the float relief valve being configured to shut when a liquid passes through the float relief valve such that the float is moved to seat on the float seat within the internal chamber.

10. An air vent assembly for a fluid piping network comprising:

a cylindrical chamber through which a fluid is configured to flow, the cylindrical chamber having a main body possessing a cross-section and opposing first and second ends, the first end being an inlet, the second end being an outlet, the cross-section of the main body being larger than a cross-section at the first and second ends, an angled port connected to the main body, the angled port being a hollow tubular member, the angled port extending from the main body to protrude beyond the main body, a portion of the angled port extending downward into an interior of the main body;

an elbow connected to the angled port; and an air release valve connected to the elbow;

wherein the portion of the angled port extending downward into the interior of the main body is configured to capture gas present in the fluid introduced through the inlet and flowing through the outlet when the piping network is filled with the fluid, the portion of the angled port extending downward into the interior of the main body comprises an air scoop that possesses a semi-cylindrical main body, and the air scoop comprises a vertical groove and a horizontal groove in the semi-cylindrical main body, the vertical groove and the horizontal groove being positioned on an upstream surface of the semi-cylindrical main body.

11. The air vent assembly of claim 10, further comprising:

a moisture detection assembly connected to an outlet port of the air relief valve; and the moisture detection assembly comprising a condensate collection chamber and a moisture detection device, the condensate collection chamber comprising a vent screen and being configured to condense and retain moisture within the condensate collection chamber, the moisture detection device fluidly-communicating with an interior of the condensate collection chamber, the moisture detection device being configured to detect moisture within the condensate collection chamber.

12. An air release assembly for a wet pipe system comprising:

a cylindrical chamber through which a fluid is configured to flow, the cylindrical chamber having an inlet, a main body with a cross-section, and an outlet, the cylindrical chamber installed in a portion of a main line of the wet pipe system, the cross-section of the main body being larger than a cross-section at the inlet and the outlet of the cylindrical chamber;

a first angled port connected to and extending vertically upward from the main body, the first angled port being a hollow tubular member, a portion of the first angled port extending downward into an interior of the main body, the portion of the first angled port configured to capture air present in the fluid introduced through the inlet and flowing through the cylindrical chamber and through the outlet when the wet pipe system is filled with the fluid;

an elbow connected to the angled port; and an air vent assembly connected to the elbow, the air vent assembly including a tubular member having an inlet through which the fluid is introduced and an outlet through which the fluid is discharged;

a first valve disposed at the inlet of the tubular member such that the fluid in the tubular member is first introduced through the first valve;

a strainer configured to remove particulate matter from the fluid, the strainer being within the tubular member;

a second angled port that vertically extends from the tubular member, the second angled port being a hollow tubular member;

an air release valve connected to the angled port; and a second valve disposed at the outlet of the tubular member such that the fluid in the tubular member is discharged through the second valve, the air release assembly further comprising:

a moisture detection assembly connected to an outlet port of the air release valve, the moisture detection assembly comprising a condensate collection chamber and a moisture detection device, the condensate collection chamber being configured to condense and retain moisture within the condensate collection chamber, the moisture detection device fluidly-communicating with an interior of the condensate collection chamber, the moisture detection device being configured to detect moisture within the condensate collection chamber; and a float relief valve connected to the moisture detection assembly, the float relief being configured to remain open when air passes through the float relief valve and the float relief valve being configured to shut when a liquid passes through the float relief valve.

13. The air release assembly of claim 12, wherein the portion of the angled port extending downward into the interior of the main body comprises an air scoop that possesses a semi-cylindrical main body, the air scoop comprises a vertical groove in the semi-cylindrical main body, the vertical groove being positioned on an upstream surface of the semi-cylindrical main body, and the air scoop comprises a horizontal groove in the semi-cylindrical main body, the horizontal groove being positioned on an upstream surface of the semi-cylindrical main body.

14. The air release assembly of claim 12, wherein the second valve has a hose connection, and the hose connection has a removable threaded cap.

15. The air release assembly of claim 12, wherein the air vent assembly is a unitary structure.

* * * * *